United States Patent [19]

Gorman

[11] 3,958,285

[45] May 25, 1976

[54] UPHOLSTERY SYSTEM METHOD AND APPARATUS

[76] Inventor: DeWitt Y. Gorman, P.O. Box 26323, Houston, Tex. 77032

[22] Filed: Dec. 19, 1974

[21] Appl. No.: 534,401

Related U.S. Application Data

[62] Division of Ser. No. 382,702, July 26, 1973, Pat. No. 3,896,531.

[52] U.S. Cl. ..... 5/353.3; 297/218

[51] Int. Cl.[2] ..... A47C 23/00

[58] Field of Search ..... 5/353.1–353.3, 5/353.5; 160/392, 394, 395, 397; 297/218

[56] References Cited

UNITED STATES PATENTS 2,237,585 4/1941 De Fries ..... 5/353.5

FOREIGN PATENTS OR APPLICATIONS 149,994 2/1953 Australia ..... 5/353.3

*Primary Examiner*—James C. Mitchell

*Attorney, Agent, or Firm*—Pravel & Wilson

[57] ABSTRACT

An upholstery system method and apparatus for furniture and the like in which the upholstery covering is releasably affixed to a base member for enabling changing of the covering as desired. A clasp apparatus adapted for mounting with the base member for releasably securing upholstery coverings such as sheets, panels, fabrics and the like with the base member is also disclosed.

7 Claims, 8 Drawing Figures

UPHOLSTERY SYSTEM METHOD AND APPARATUS

CROSS-REFERENCE TO RELATED APPLICATIONS

This is a division of application Ser. No. 382,702, filed July 26, 1973 now U.S. Pat. No. 3,896,531.

BACKGROUND OF THE INVENTION

This invention relates generally to the field of an upholstery system method and apparatus and more particularly to an upholstery system for securing upholstery coverings and the like with a base member to form a cushion structure without sewing or otherwise seaming the covering.

Upholstering of furniture and the like has previously required the expensive services of skilled craftsman in fabricating and permanently attaching the covering material to furniture. Damage to such upholstery was expensive and difficult to properly repair which was a major disadvantage in some commercial applications where the furniture was continually subjected to extreme abuse. In addition, permanently attached decorative upholstery coverings have limited the number of creative options available to interior decorators as well as requiring furniture dealers to stock large expensive inventories of furniture.

Snap fasteners or clasps, such as disclosed in U.S. Pat. Nos. 1,896,200 and 1,907,785, have been known for some time. Many fasteners, such as disclosed in U.S. Pat. No. 3,310,861 were permanently deformed when installed were therefore usable only once. Specialized fasteners used for particular purposes as disclosed in U.S. Pat. No. 1,864,477 were also known. Other prior art fasteners, for example, such as disclosed in U.S. Pat. No. 1.940,636, required that special tools be used to attach the clasp or fastener.

SUMMARY OF THE INVENTION

Method and apparatus for an universal upholstery system suitable for use with furniture in which a covering is releasably affixed to a base member to permit rapid and frequent changing of the covering when desired without special tools or skills while presenting a pleasing appearance comparable to that achieved by conventional upholstering methods. A clasp apparatus having a clamp frame, mountable with a cushion base, for receiving and holding a plurality of resiliently deformable steel strip beam members therein for securing upholstery fabrics and the like with the clasp frame in response to the deformation of the steel strips is employed to form an upholstery cushion.

An object of the present invention is to provide a new and improved upholstery system method and apparatus.

Another object of the present invention is to provide a new and improved clasp apparatus.

A further object of the present invention is to provide a new and improved upholstery cushion.

DESCRIPTION OF THE PREFERRED EMBODIMENT

Figure 1:
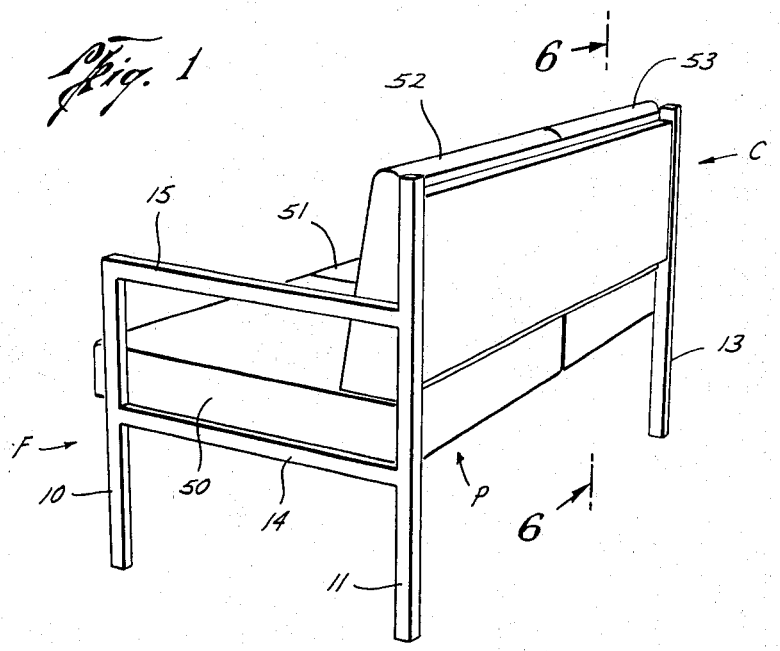
FIG. 1 is a perspective view of the back portion of an upholstered chair utilizing the upholstery system of the present invention.

FIG. 1 illustrates a chair device C employing the upholstery system method and apparatus of the present invention. While the preferred embodiment of the present invention disclosed will be for a two person chair device C, it is readily apparent that the chair device C may include either single person chair devices or chair devices capable of supporting more than two persons.

The chair device C includes a support frame F and one or more support pads P mountable on the frame F. The pads P may be provided with a layer of cushioning material for the user and may be dimensioned to provide support for more than a single user.

Figure 5:
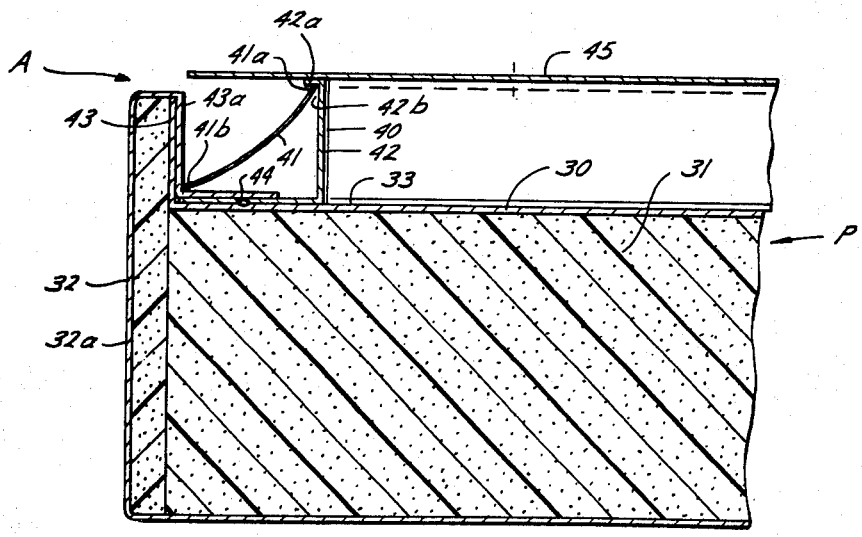
FIG. 5 is a veiw taken along lines 5—5 of FIG. 4.

The present invention is also directed to a clasp apparatus, generally designated A in FIG. 5, mounted with a pad base structure for releasably securing upholstery coverings, sheets, panels, films, fabrics and the like with the structure in a desired manner. The clasp apparatus A is equally well suited for releasably securing any material of this general nature and the apparatus A should not be considered limited in any manner by the type or nature of the materials secured thereby.

The clasp apparatus A is particularly well suited for use in upholstering furniture and will be disclosed hereinafter for use in the upholstered chair device, but the clasp apparatus A should not be considered limited to upholstered furniture as it may be utilized in other applications although it is an integral portion of the upholstery system of the present invention.

Figure 2:
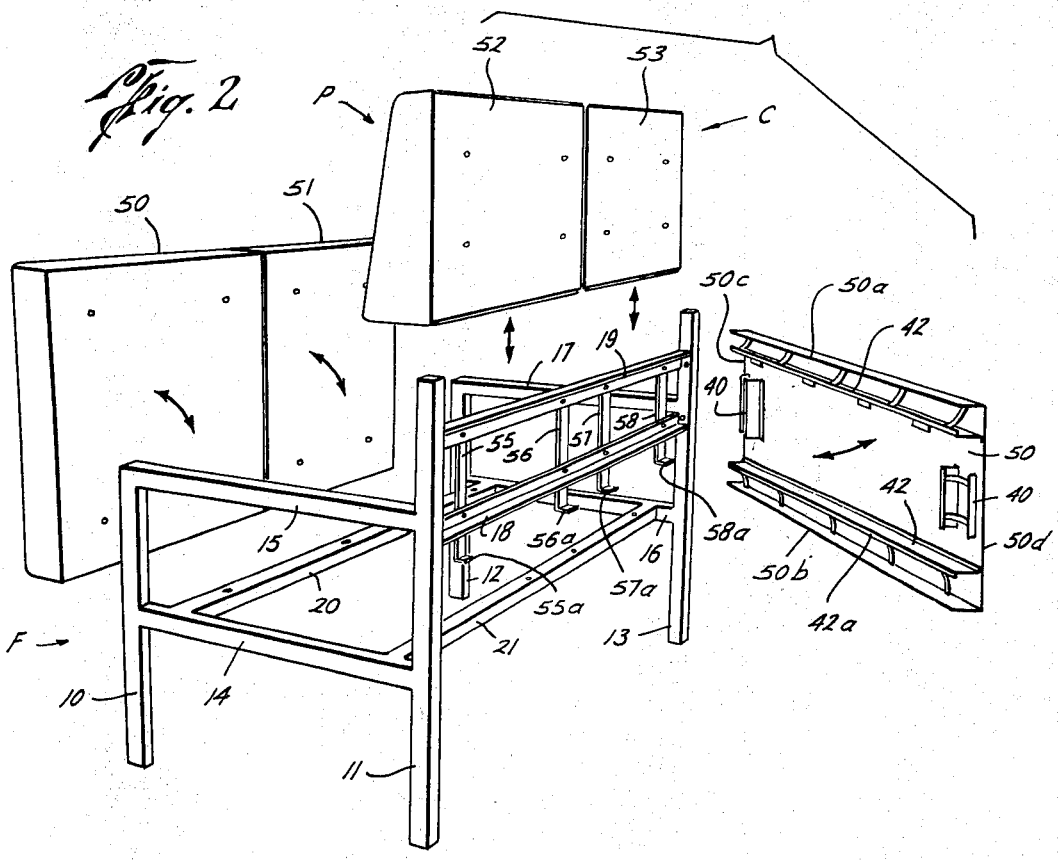
FIG. 2 is a view similar to FIG. 1 illustrating the manner of assembly of upholstered cushions with the chair frame.

As illustrated in FIG. 1 and 2, the support frame F includes one or more substantially vertical or upright support members 10, 11, 12 and 13. The front vertical leg 10 is connected to the rear vertical leg 11 by a pair of spaced, parallel, horizontal members 14 and 15, with the upper horizontal member 15 also providing or forming an arm rest as is well known. The front and rear vertical legs 12 and 13 are connected in a similar manner by the horizontal members 16 and 17. The rear vertical legs 11 and 13 are connected by a pair of spaced, substantially horizontal members 18 and 19 which also provide back support for the frame F while the lower horizontal side support members 14 and 16 are connected by a pair of spaced parallel members 20 and 21. Preferably, but not necessarily, the frame F is made from structural aluminum or steel members and fabricated by welding to achieve a pleasing appearance. The support frame F may be designed in any style and as noted hereinabove designed to support any number of users. Also, if desired, the arm rest formed by the upper horizontal members 15 and 17 may not be employed.

The upholstery pads P are mounted or located on the frame F to provide desired support for the user in the well known manner. As illustrated in FIG. 5, the pads P include a pad base or structural frame member 30 of any desired shape for mounting a suitable cushion or padding material 31 for user comfort. The padding material 31 may also be of any desired shape and is covered by an upholstery fabric or covering 32 is releasably secured to the pad base or structural frame 30 by the clasp apparatus A and which may also, but not necessarily, serve to secure the cushion 31 with the structure 30.

The clasp apparatus A, illustrated in FIG. 5, includes a clamp frame 40 mounted with a substantially flat lower surface 33 of the pad structural member 30 about its periphery and a resiliently deformable beam or clip member 41 mounted with the clamp frame 40 at a first end 41*a* and with a second end 41*b* coacting with the clamp frame 40 for securing the sheet of upholstery material 32 with the clamp frame 40 in response to the deformation of the beam member 41. It will be immediately apparent to those skilled in the art that the fabric 32 may be placed in engagement with either the first end 41*a* or the second end 41*b* of the beam 41 or both ends 41*a* and 41*b* for securing the fabric 32 with the clamp frame 40.

The clamp frame 40 is preferably formed of a pair of longitudinally extending structural angle members 42 and 43 secured together, such as by spaced spot welds 44, to form a substantially U-shaped channel member having a substantially uniform cross-sectional shape along its entire longitudinal length. In the embodiment illustrated in FIG. 5, the angle member 43 is formed integral with the structural support member 30, but it is readily apparent that the member 43 may be formed by a separate member secured to the structural member 30. Both the formation of the clamp frame 40 integral with and mountable on the base member 30 is within the scope of the present invention. The first member 42, having a shoulder portion 42*a* extending therefrom, forms a first surface shape or corner 42*b* for receiving the end 41*a* of the beam 41 and holding the end 41*a* in a position for blocking undesired movement of the beam to release the desired securing deformation when secured in the clamp frame 40. The frame 40 forms a second surface shape or corner 43*a* with the inner surface of the angle 43 having a shape coacting with the end 41*b* for securing the upholstery fabric 32 with the clamp frame 40 while blocking undesired movement of the end 41*b* of the beam 41 to release the desired securing deformation of the beam 41. The distance between the spaced, parallel corners 42*b* and 43*a* of the frame 40 are dimensioned less than the length of the beam 41 to resiliently deform the beam 41 when secured therein for holding the fabric 32 in position. The lip 42*a* is sized to enable the beam 41 to move into the securing position by deformation thereof and which will move to the securing position by resilient recovery from the deformed position in moving past the lip or shoulder 42*a*. Preferably, the shoulder 42*a* is dimensioned to enable the beam 41 to be snapped into position or removed by hand and without the need for special tools and the like.

For ease of releasably securing the securing fabric 32 with the clamp frame 40, the beam 41 is preferably formed from a ribbon-like strip of spring steel which may be easily snapped in and out of the frame 40 by manipulation with the thumb and finger when desired. This construction enables the installation and removal from the clamp frame 40 of the beams 41 at a plurality of locations along the frame 40 for securing the fabric 32 without damage thereto or the need for special tools or training.

An escutcheon or decorative panel 45 may be secured with the base member 30 to conceal the clasp apparatus A and provide a more pleasing appearance to the pads P.

Figure 8:
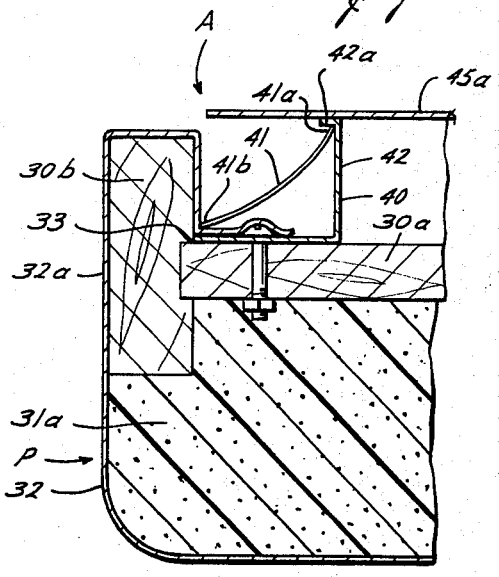
FIG. 8 is a side view in section, of an alternate cushion employing the clasp apparatus of the present invention.

A second embodiment of the clasp apparatus A is illustrated in FIG. 8, where the clamp frame 40 is secured with illustrated in FIG. 8, where the clamp frame 40 is secured with a wooden pad structure member 30*a* having a peripheral edge member 30*b* mounted therewith which cooperates with the angle member 42 to form the clamp frame 40 for deformably receiving the beam or snap member 41 therein. One or both ends of the beam 41 may cooperate with the clamp frame 40 for securing the upholstery fabric 32*a* with the frame 40 in response to the deformation of the beam 41. A suitable panel 45*a* may be utilized in this embodiment to shield the clasp apparatus A from view and which is secured with the frame member 30*a* by any suitable means (not illustrated).

In the use and operation of the present invention, the frame F is fabricated as desired in any well known manner. The cushion or pad frames 30 are independently formed to provide the projecting member 43 thereon. The angles 42 are then located adjacent the member 43 with the longitudinally extending lip portion 42*a* projecting towards the peripheral member 43 and secured with the structural member 30. The layer of cushion material means 31 is then mounted with the frame 30 and is preferably secured in a desired position by suitable means such as glueing and the like. Any suitable resilient cushioning material such as a spring arrangement or foamed rubber-like material may be employed although use of the latter is illustrated. The cushioning material may be encapsulated in a fabric covering in the usual manner, but such a covering is not necessary. The cushioning material 31 may be of uniform thickness, such as employed in the bottom cushions 50 and 51 or may be of a non-uniform thickness or shape such as employed in the back cushions 52 and 53. The clasp apparatus A of the present invention is equally well suited for any shape of cushioning material 31.

The upholstery fabric 32 is then placed on a work surface with a desired outside facing or viewed surface 32*a* facing downwardly. Should it be desirable to use an inner covering 34 (FIG. 3) to provide a slip plane for enabling relative movement between the layer of cushioning material 31 and the outer or upholstery covering 32 it is then placed over the covering 32. The frame 30 and cushion material 31 are then placed on the upholstery fabric 32 with the cushion material 31 adjacent the covering 32. One peripheral edge of the upholstery material is placed in the clamp frame 40 and a plurality of beams 41 are snapped into the securing position to secure the material 32 along one edge of the cushion or pad P. The opposite edge of the upholstery material is then placed in the clamp frame 40 opposite the previously secured edge and a plurality of beams 41 are snapped in the securing position in the clamp frame 40 along this edge of the pad P to secure the upholstery material 32 with the opposite edge of the cushion P. Trimming of the upholstery material 32 is not necessary to place the cushion P in the condition illustrated in FIG. 3.

Figure 3:
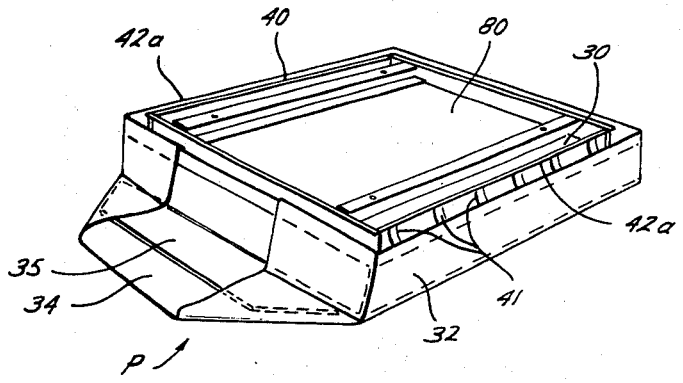
FIG. 3 is a perspective view of an inverted seat cushion with the upholstery material partially installed.
Figure 4:
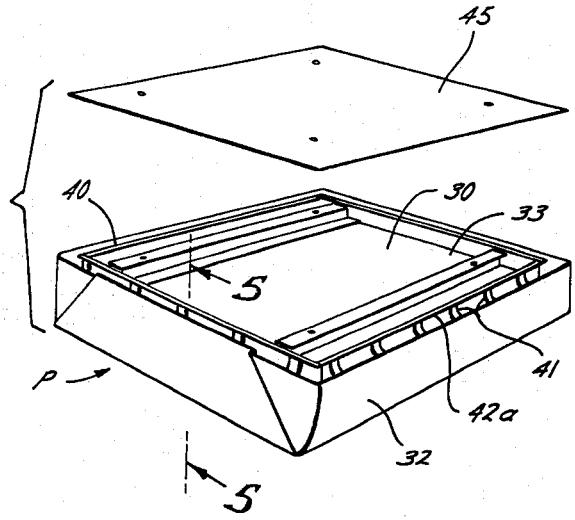
FIG. 4 is a view similar to FIG. 3 with the upholstery material fully installed and bottom covering aligned for attachment.

At this time, it is only necessary to repeat the sequence of positioning the remaining edges of the upholstery material in the clamp frame 40 and snapping the plurality of beam members 41 into position for securing these two opposite edges of the upholstery material with the clamp frame 40. It will also be immediately appreciated that the clasp apparatus A of the present invention is equally well suited for use with angular-folded crease corners (FIGS. 3 and 4) and square-folded crease corners (FIGS. 1, 2, 6 and 7) although the latter is preferred. As illustrated in FIG. 3, a flat fold bar member 35 may be placed in either type of corner fold to present an attractive wrinkle-free covering 32 when viewed by hiding the folded double thickness of material behind the member 35. The covering panel 45 is then secured in position by attaching to the cushion base 30 and the cushion P is then complete. The above sequence is repeated to assemble any number of desired cushions P. While the most desirable shaped cushion for ease of assembly is square, the shape and size of the cushion may be varied as desired.

Figure 6:
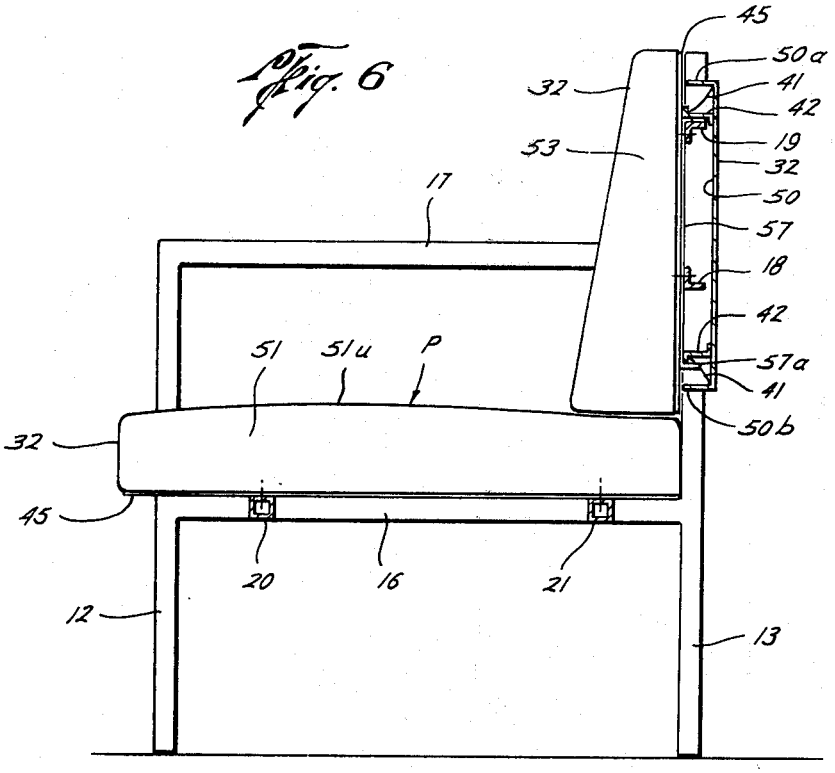
FIG. 6 is a view taken along lines 6—6 of FIG. 1.
Figure 7:
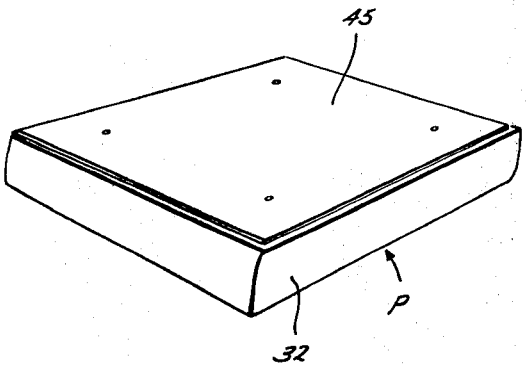
FIG. 7 is a view similar to FIG. 4 illustrating a second manner of installing the upholstery material.

As illustrated in FIG. 6, the cushions P are preferably given a slightly domed shape adjacent the cushion support area indicated at 51u prior to mounting on the frame F to provide sufficient slack in the covering 32 when the cushions P are used to eliminate undesired stretching or deformation of the covering 32. The dome effect may be achieved when initially forming the dome with the cushion material 31, by adding appropriately shaped additional layers of cushion material either before or after securing the covering 32 to the frame 30 or by the use of a removably securable support pan like plate 80 (FIG. 3) forcing the center of the cushion material 32 into the shape of a dome. Of course, the dome effect may be obtained by other methods well known to those skilled in the art.

The bottom or seat cushions 50 and 51 are secured with the horizontal members 20 and 21 by any suitable means, such as, but not limited to, bolting and the like. The back cushions 52 and 53 are secured to the back supports 18 and 19 in a similar manner.

As illustrated in FIG. 2, clasp apparatus A of the present invention may also be utilized to releasably secure an upholstery fabric with a base member or removable panel 50 employed to provide a more desirable appearance for the chair C. The panel 50 includes upper and lower rearwardly extending peripheral lips or edges **50*a* and 50*b* cooperating with a pair of angles 42 to form a clamp frame adjacent the edges 50*a* and 50*b*. Separate U-shaped clamps 40 are secured to the back side of the panel 50 adjacent to edges 50*c* and 50*d* for securing the upholstery fabric 32 along those edges. The upholstery fabric 32 is installed in the peripheral clamp frame 40 along the edges 50*a*, 50*b*, 50*c* and 50*d*** in the manner set forth hereinabove.

Mounted with the horizontal back braces 18 and 19 and a plurality of four downwardly projecting resilient mounting fingers 55, 56, 57 and 58 respectively. As illustrated in FIG. 6, the members 55, 56, 57 and 58 are dimensioned to receive the angle 42 adjacent the lower surface **40*b* on the lugs 55*a*, 56*a*, 57*a* and 58*a* respectively, for supporting the panel. The angle 42 adjacent the upper edge 50*a* is dimensioned to engage the horizontal cross-member 19 for supporting the panel 50 thereon, and for forcing the portion 42*a* of the frame 42 adjacent the lower shoulder 50*b* to deform the lugs 55*a*, 56*a*, 57*a* and 58*a* for securing the panel 50 with the frame F. Other means of securing the base member are panel 50** with the frame F without departing from the scope of the present invention.

The foregoing disclosure and description of the invention are illustrative and explanatory thereof, and various changes in the size, shape, and materials as well as in the details of the illustrated construction may be made without departing from the spirit of the invention.

I claim:

1. An upholstery unit, including:

a cushion base adapted for mounting with a support structure and having a plurality of corners;

cushioning means mounted with said base for providing a resilient support to a user;

a foldable unformed sheet of decorative upholstery covering arrangeable about said cushion base and said cushioning means and folded adjacent each of said corners to provide a viewed surface of pleasing appearance;

a shield member positioned within at least one fold to eliminate wrinkles formed in said viewed surface of the sheet of upholstery covering by the folded portion of the sheet of upholstery covering folded behind said viewed surface; and means for releasably fastening with said base sheet of unformed decorative upholstery covering arranged about said cushioning means to removably secure said sheet of unformed upholstery covering about said cushioning means in a manner to provide a substantially wrinkle free appearance of upholstery covering.

2. The apparatus as set forth in claim 1, wherein said means for releasably fastening includes:

a plurality of clip members with each of said plurality of clip members in engagement with said sheet of upholstery covering for providing a force to secure said sheet of unformed upholstery covering with said base frame.

3. The apparatus as set forth in claim 2, wherein:

each of said plurality of clip members engages said sheet of upholstery covering to secure said sheet of upholstery covering with said base frame without damaging said sheet of upholstery covering.

4. The apparatus as set forth in claim 3, wherein:

each of said plurality of clip members is placed in engagement with said sheet of upholstery covering without the use of tools for providing the securing force.

5. The apparatus as set forth in claim 3, wherein:

each of said plurality of clip members is released from engagement with said sheet of upholstery covering without the use of tools for removing the securing force.

6. The apparatus as set forth in claim 5, wherein:

each of said plurality of clip members is reusable for providing a force to secure said sheet of upholstery covering with said base frame.

7. The apparatus as set forth in claim 3, including:

a clamp frame mounted with said cushion base member and having a first co-acting corner and a second co-acting corner located in spaced relationship; and each of said plurality of clip members co-acting with said first corner and said second corner for providing a force for securing said sheet of upholstery covering with said base member.

* * * * *